United States Patent [19]

Seaborn

[11] 3,950,107

[45] Apr. 13, 1976

[54] BINDER RING

[75] Inventor: Paul E. Seaborn, Los Gatos, Calif.

[73] Assignee: The Mead Corporation, Dayton, Ohio

[22] Filed: June 26, 1974

[21] Appl. No.: 483,123

[52] U.S. Cl. ..... 402/22; 24/16 PB; 402/75

[51] Int. Cl.[2] ..... B42F 3/02

[58] Field of Search ..... 402/19, 20, 21, 22, 23, 402/70, 75; 24/16 PB; 85/DIG. 2

[56] References Cited

UNITED STATES PATENTS

| | | | |
|---|---|---|---|
| 2,321,559 | 6/1943 | Trussell | 402/21 |
| 2,910,068 | 10/1959 | Lane | 402/22 |
| 3,236,242 | 2/1966 | Galiley | 402/22 |
| 3,251,364 | 5/1966 | Goldman | 402/22 |
| 3,313,303 | 4/1967 | Beyer | 402/22 |
| 3,325,853 | 6/1967 | Stroweis | 24/16 R |
| 3,516,124 | 6/1970 | Merser | 24/16 PB |
| 3,529,795 | 9/1970 | Van Niel | 24/16 PB |
| 3,529,900 | 9/1970 | Pettit | 402/22 |
| 3,632,218 | 1/1972 | Zippel | 402/33 |

FOREIGN PATENTS OR APPLICATIONS

| | | | |
|---|---|---|---|
| 59,846 | 5/1958 | India | 24/16 PB |

*Primary Examiner*—Jerome Schnall
*Attorney, Agent, or Firm*—Biebel, French & Nauman

[57] ABSTRACT

A one-piece, molded plastic binder ring that may be formed with an integral post for attaching the binder ring to the spine of a loose leaf cover. The binder ring includes a T-shaped socket in its base which receives a cross bar of a flexible strap molded integrally with the base, and locking projections are formed in the socket to lock the strap cross bar in a pocket formed in lower surface of the base of the binder ring.

5 Claims, 11 Drawing Figures

BINDER RING

BACKGROUND OF THE INVENTION

A number of loose leaf binders currently available may be manufactured relatively inexpensively and typically they are of molded plastic construction. Several patents disclose binders of this general type.

For example, U.S. Pat. Nos. 3,251,364; 3,313,304; and 3,529,900 disclose binders in which a single mounting strip is provided with a plurality of binder rings. Additionally, U.S. Pat. No. 3,313,303 discloses a binder in which the binder rings are attached to sectional mounting strips which can be interconnected, and U.S. Pat. No. 3,236,242 discloses a loose leaf binder which utilizes individual binder rings which can be attached separately to the binder cover.

SUMMARY OF THE INVENTION

The present invention provides a one-piece molded plastic binder ring which may be constructed with an integrally formed post which serves as a rivet for attaching the binder ring to a loose leaf cover and which includes a unique construction for locking the binder ring in a closed position.

Specifically, the base of the binder ring is provided with a slot which appears T-shaped from the upper surface of the base and which receives a cross bar formed on an end of a flexible strap which is molded integrally with the base. The T-shaped slot is formed with the head of the T intermediate the stem of the slot and the flexible strap, so that the natural resiliency of the strap material tends to move the strap into the stem of the T to prevent inadvertent opening of the binder ring.

To insure further against inadvertent disengagement of the strap cross bar from the stem portion of the T-shaped socket in the base, locking projections are provided adjacent the intersection of the stem and the head of the T-shaped socket which engage the cross bar of the strap and resist disengagement when a pulling force is applied to the strap.

A pair of spaced, parallel legs extend along opposite sides of the stem portion of the T-shaped socket and have their upper surfaces flush with the upper surface of the base of the ring binder and their lower surfaces positioned intermediate the upper and lower surfaces of the base. This provides a pocket on the lower surface of the base. This provides a pocket on the lower surface of the base which allows the cross bar to be locked in position when the base is attached to the binder cover with the lower surface of the base seated firmly against the cover surface.

For attaching the binder ring to a cover, a post may be molded integrally with the base and project from the lower surface thereof. After the post has been inserted in a preformed opening in the cover, its outwardly projecting end can be expanded by ultrasonic energy, thus both eliminating the necessity of a separate rivet and simplifying the attachment of the binder ring to a cover. Preferably a single, integral post is provided for each binder ring, although it will be apparent that two or more posts may be utilized or the base may be provided with an opening to receive a conventional rivet.

DESCRIPTION OF THE PREFERRED EMBODIMENTS

Figure 1:
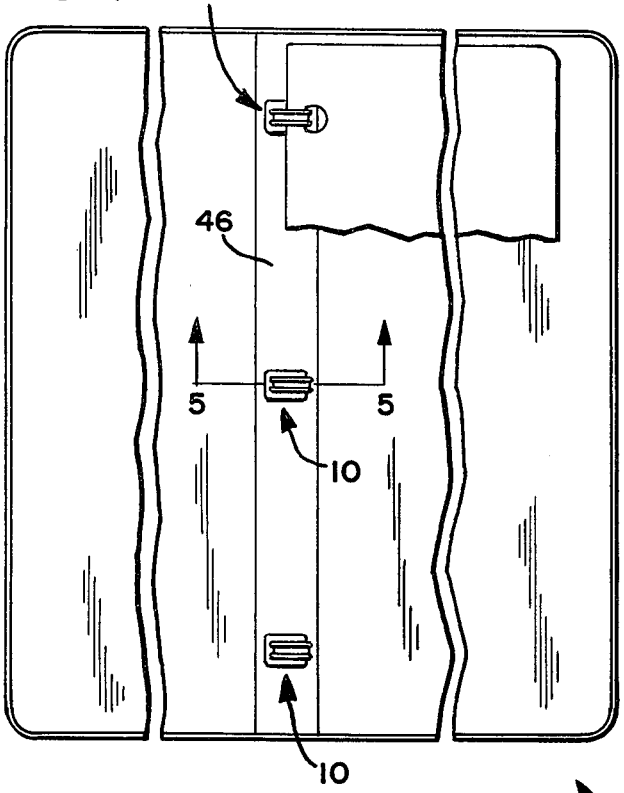
FIG. 1 is a view of a loose leaf binder incorporating the binder rings of the present invention.
Figure 2:
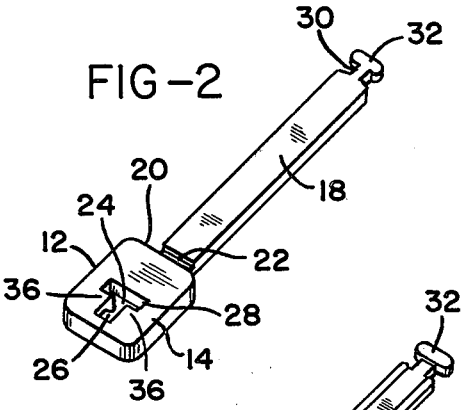
FIG. 2 is a perspective view of a binder ring viewed from the upper surface thereof.

FIG. 1 of the drawings depicts a typical loose leaf binder cover incorporating binder rings 10 of the present invention. Although three rings are shown for purposes of illustration, it will be apparent that the number of rings may be varied as desired.

The binder rings 10, as best seen with reference to FIGS. 2 through 8 of the drawings, includes a base portion 12 having upper and lower surfaces 14 and 16, respectively, and a flexible strap 18 formed integrally with the base and projecting from a side 20 thereof. At the intersection of the strap 18 and the side 20 of the base 12, the thickness of the strap is reduced, as at 22, to improve the flexibility of the connection between the strap and the base. Additionally, the binder rings 10 are constructed by molding from a material such as polypropylene which has an inherent flexibility.

The base 10 has formed therein a socket 24 which has a substantially T-shaped configuration as viewed from the upper surface of the base 12, with the stem 26 of the T extending parallel to the strap 18 and the head 28 of the socket positioned between the stem 26 and the strap 18. The outer end of the strap 18 has a reduced portion 30 defining a cross bar 32 extending substantially parallel to the head 28 of the socket 24 and being of a length less than the length of the head of the socket 28 and greater than the width of the stem 26.

Figure 3:
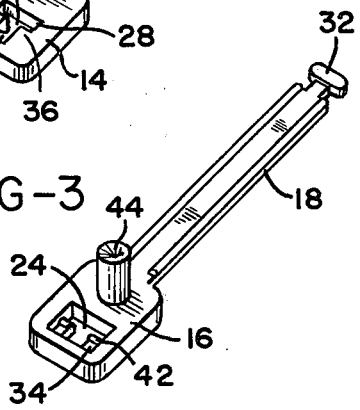
FIG. 3 is a view similar to FIG. 2 but showing the undersurface of the binder ring.
Figure 6:
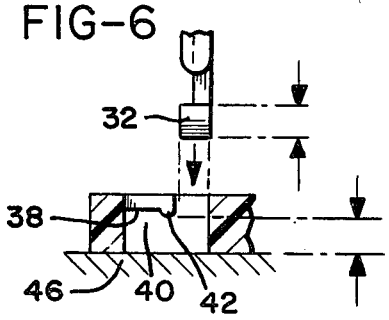
FIG. 6 is a view of a portion of the binder ring showing the cross bar thereof being moved into the socket thereof.
Figure 7:
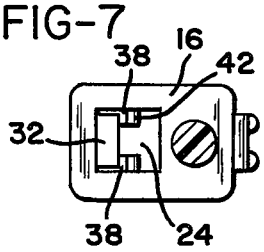
FIG. 7 is a view taken on line 7—7 of FIG. 5.

As best seen in FIGS. 3 and 7 of the drawings, the socket 24 has a substantially rectangular configuration as viewed from the lower surface 16 of the base 12. A pair of spaced parallel legs 34 define the stem portion 26 of the socket and have their upper surfaces 36 flush with the upper surface 14 of the base and their lower surfaces 38 disposed intermediate the upper and lower surfaces of the base member 12, thereby defining a pocket 40, as best seen in FIGS. 4 and 6 of the drawings.

The ends of the legs 34 adjacent the head 28 of the socket are provided with locking portions 42 projecting downwardly from their lower surfaces 38. Additionally, in a preferred embodiment of the invention, a single post 44 is formed integrally with the base 12 and projects downwardly from its lower surface 16.

Figure 4:
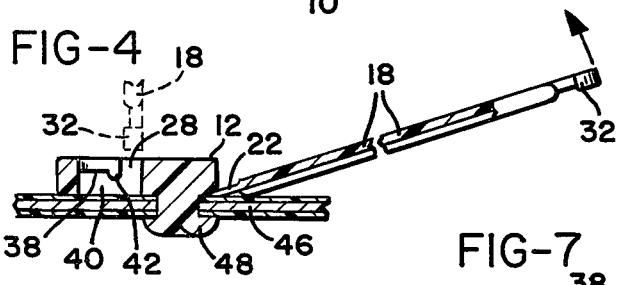
FIG. 4 is a view of a binder ring attached to a spine, with parts in section.
Figure 5:
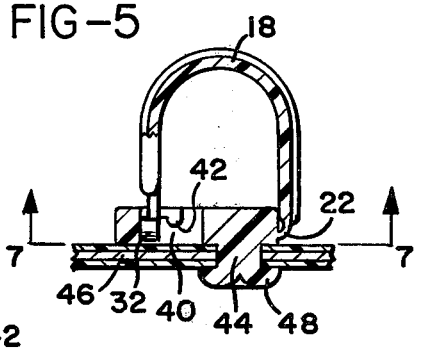
FIG. 5 is a view taken on line 5—5 of FIG. 1.

With this construction, the rings 10 are attached to the spine 46 of a binder by inserting the post 44 through a preformed hole in the binder and then expanding the outwardly projecting end of the post into a head 48, as seen in FIGS. 4 and 5 of the drawings. Conveniently the expansion of the outwardly projecting end of the post 44 can be accomplished by the application of ultrasonic energy.

Figure 8:
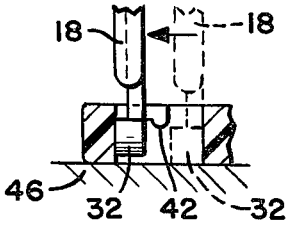
FIG. 8 is a view similar to FIG. 6, but showing the cross bar of the binder ring locked in position.

With the binder rings 10 attached to the spine 46, the rings may be moved from the open position shown in FIGS. 1, 5 and 8 by first moving the strap 18 upwardly about its point of connection 22 to the base 12, as indicated by the arrow in FIG. 4 of the drawings. The strap 18 may then be bent to a substantially inverted U-shape configuration and its cross bar 32 positioned opposite the head 28 of the socket, as indicated by phantom lines in FIG. 4 of the drawings.

It is then moved downwardly in a direction indicated by an arrow in FIG. 6 of the drawings, until it abuts the surface of the spine 46 against which the lower surface 16 of the base 12 is seated. In this regard, it will be noted from FIG. 6 that the depth of the cross bar 32 is such that it clears the locking projections 42 when it is in engagement with the surface of the spine 46, as shown in phantom lines in FIG. 8 of the drawings.

The cross bar 32 is then moved in a direction indicated by an arrow in FIG. 8 of the drawings and the material resiliency of the strap 18 and its connection to the base 12 cause the cross bar to be urged to the left as seen in FIG. 8 and upwardly against the lower surfaces 38 of the legs 34. This tends to retain the cross bar 32 in the stem 36 of the socket. The projections 42, of course, also act to prevent inadvertent disengagement of the cross bar 32 from the socket 24, as it readily apparent from FIGS. 5 and 8 of the drawings.

Figure 10:
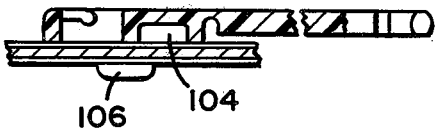
FIG. 10 is a view, partly in section showing the embodiment of FIG. 9 attached to a binder.
Figure 9:
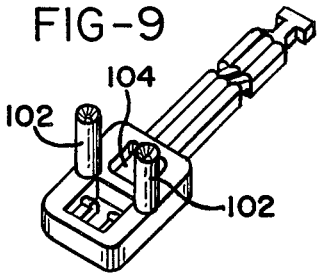
FIG. 9 is a view similar to FIG. 3 showing a second preferred embodiment of the invention.

Turning now to FIGS. 9 and 10 of the drawings, a modified version of the binder ring described above will be described. Thus, the binder ring 100, rather than utilizing a single post for attachment, is provided with a pair of smaller posts 102. Additionally, because the posts are disposed adjacent opposite sides of the base of the binder ring, the amount of material utilized in the ring 100 can be reduced by forming a cavity 104 in the lower surface thereof.

In all other respects the binder ring 100 can be constructed the same as the binder ring 10 and the outwardly projecting ends of the posts 10 also can be expanded, as indicated at 106, similarly to the end 48 of the post 44 to attach the binder ring 100 to the spine of a loose leaf binder.

Figure 11:
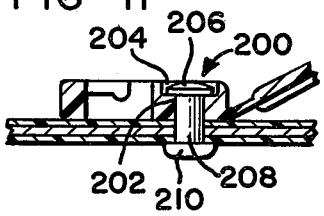
FIG. 11 is a view, partly in section, showing a third embodiment of the invention.

FIG. 11 of the drawings discloses a third embodiment of the present invention. The binder ring 200 is provided with an opening 202, counter-sunk at 204 to accommodate the head 206 of a rivet 208. The rivet 208 may be of conventional construction and attachs the ring 200 to the spine of a loose leaf binder by having its outer end 210 expanded. Thus, in place of a single post 44 or a pair of posts 102, the binder ring 200 is attached by means of a separate rivet 208. In all other respects the binder ring 200 is the same as that shown in the previous two embodiments.

From the above it will be apparent that the present invention provides a one-piece, molded plastic binder ring having unique interengaging fastening means and which may be constructed with an integrally formed post for attaching the binder ring to the spine of the binder.

While the products herein described constitute preferred embodiments of the invention, it is to be understood that the invention is not limited to these precise products, and that changes may be made therein without departing from the scope of the invention.

What is claimed is:

1. A binder construction comprising:

a. a molded plastic base having upper and lower surfaces and a continuous closed perimeter joining said upper and lower surfaces, b. a flexible strap formed integrally with said base, projecting from a side thereof and terminating in a cross bar extending perpendicularly to said strap, c. means defining wholly within said perimeter of said base a socket for receiving a portion of said flexible strap and said cross bar, d. said socket having a substantially rectangular configuration as viewed from the bottom of said base, e. a pair of spaced parallel legs disposed within said socket, f. said legs having upper surfaces thereof substantially flush with said upper surface of said base and lower surfaces thereof positioned within said socket inwardly from said lower surface of said base, g. said legs extending from the side of said socket opposite the side of said base from which said strap projects, h. said spaced parallel legs terminating short of the side of said socket opposite the side from which they extend and defining thereby a substantially T-shaped configuration in said base as viewed from the top thereof, i. locking means projecting downwardly from said lower surfaces of said legs adjacent outer ends thereof toward the plane of said lower surface of said base, j. said cross bar being no longer in length than the width of said socket measured parallel to said cross bar but longer then the spacing between said spaced parallel legs, k. the spacing between said spaced parallel legs being sufficient to receive therebetween that portion of said strap adjacent said cross bar but being substantially less than the length of said cross bar so that said cross bar engages said locking mean when disposed under said legs, and l. securing means on said base for securing said base to a cover, said securing means being positioned intermediate said socket and said strap.

2. The binder of claim 1 further comprising:

a. said securing means comprises post means formed integrally with and projecting from said lower surface of said base.

3. The binder construction of claim 2 wherein said post means comprises:

a. a single rivet post projecting from said lower surface of said base.

4. The binder construction of claim 2 further comprising:

a. a binder cover having means defining an opening therethrough, b. said post means being received in said opening defining means in said cover, and c. means defining an enlarged section on an outwardly projecting portion of said post means.

5. The binder construction of claim 1 further comprising:

a. said securing means defining a rivet hole through said molded plastic base.

* * * * *